United States Patent [19]

Frisbee

[11] Patent Number: 5,010,961

[45] Date of Patent: Apr. 30, 1991

[54] ANGLE-TILT-PITCH MECHANISM FOR DOZER BLADE

[75] Inventor: Claude M. Frisbee, Schofield, Wis.

[73] Assignee: J. I. Case Company, Racine, Wis.

[21] Appl. No.: 481,928

[22] Filed: Feb. 20, 1990

[51] Int. Cl.[5] ..... E02F 3/76

[52] U.S. Cl. ..... 172/821; 172/831

[58] Field of Search ..... 172/445.2, 810, 811, 172/828, 818–823, 831; 37/234–236, 231, 283, DIG. 10, DIG. 11

[56] References Cited

U.S. PATENT DOCUMENTS

| | | | |
|---|---|---|---|
| 2,943,407 | 7/1960 | Long | 37/DIG. 10 X |
| 3,529,678 | 9/1970 | Teasdale | 172/821 |
| 4,201,268 | 5/1980 | Frisbee | 172/821 X |
| 4,281,721 | 8/1981 | Beales | 172/821 |
| 4,405,019 | 9/1983 | Frisbee | 172/821 X |
| 4,424,871 | 1/1984 | Stickney | 172/821 |
| 4,562,891 | 1/1986 | Ranner | 172/821 |
| 4,848,483 | 7/1989 | Heiple | 172/821 |
| 4,893,683 | 1/1990 | Horsch et al. | 172/821 |

*Primary Examiner*—David H. Corbin
*Assistant Examiner*—Jeffrey L. Thompson
*Attorney, Agent, or Firm*—Dykema Gossett

[57] ABSTRACT

An improved mechanism for connecting a ground-engaging blade to the frame of a vehicle is disclosed which allows the blade to tilt, pitch or angle relative to the frame. The disclosed arrangement includes a pair of hydraulic cylinders which control the tilting or pitching of the blade and a single hydraulic cylinder which controls the angling of the blade. The cylinders are all pivotally connected to an intermediate member which is pinned to the blade and guided through an arc on the frame by a guide bar formed on the frame. A single hydraulic circuit is disclosed which powers the pair of hydraulic cylinders to pitch or tilt the blade relative to the frame. The resulting arrangement is both simplified and relatively stable when compared to prior art structures.

12 Claims, 5 Drawing Sheets

ANGLE-TILT-PITCH MECHANISM FOR DOZER BLADE

BACKGROUND OF THE INVENTION

This application relates to bulldozers or earth-working machines having ground-engaging, material-moving blades and more particularly to an improved and simplified mechanism for angling, tilting, and pitching the material-moving blade.

It is known to provide bulldozers or earth-working machines with a pusher frame of C-shaped configuration that fits between track frames and the front end of a tractor for driving the blade. The rear ends of two arms of the C-shaped frame are pivotally connected to sides of the tractor frame and permit vertical raising and lowering of the C-shaped frame about a transverse axis. This permits the blade to be moved from a ground-working position to a transport position.

A known prior art device disclosed in U.S. Pat. No. 4,201,268 was invented by the inventor of the present application. In this device a frame extends along, and defines, a longitudinal axis. The blade is driven to pitch by rotating about an axis transverse to this longitudinal axis, angle about an axis extending vertically from the longitudinal axis, and tilt about the longitudinal axis. In this prior art device, the pitching and angling are provided by a pair of hydraulic cylinders while the tilting is provided by a single hydraulic cylinder. The cylinders are all pinned to the frame. While this type of prior art device has proved quite beneficial, it is now desired to further improve this mounting arrangement.

In the prior art some difficulty was encountered in connecting the necessary hydraulic cylinders to the blade and frame. Since the blade moves about three axes relative to the frame, the connections were complicated.

Also, a blade is usually driven to pitch or tilt through only a small angular extent while normally driven to angle through a greater angular extent. For this reason, it may be beneficial to provide both the tilting and the pitching with a pair of hydraulic cylinders and the angling with a single cylinder. The prior art cyliner construction and circuitry had to provide for both accurate small movements for pitching and relatively greater movement for angling. It can be difficult to achieve both goals. In addition, the prior art may not always have adequately guided the blade as it angled relative to the frame.

It is therefore an object of the present invention to provide an improved tilt-pitch-angle mechanism for attaching a dozer blade to a frame in which the movement of the blade about the three axes relative to the frame is achieved in a simplified manner while ensuring that the blade is accurately guided about the axes.

SUMMARY OF THE INVENTION

The present invention achieves the above-stated goals by mounting a ground-engaging blade to the frame of a vehicle through a mechanism that allows the blade to pitch forwardly or rearwardly by pivoting about an axis transverse to a longitudinal axis defined by the frame, to tilt by pivoting about the longitudinal axis, or to angle by pivoting about an axis extending vertically to the longitudinal axis. In a disclosed embodiment of the present invention, the tilting and pitching are achieved by a pair of hydraulic cylinders, and the angling is achieved by a single hydraulic cylinder and an intermediate member that interconnects the blade, the cylinders and the frame.

In a disclosed embodiment of the present invention, a single hydraulic circuit controls the pitching and tilting of the blade by the pair of hydraulic cylinders and includes a pair of two-way valves. One of the two-way valves has a tilt position and a pitch position and the second of the two-way valves is moved between two positions to control the direction of pitch or tilt. A separate hydraulic circuit controls the single hydraulic cylinder to drive the blade to angle relative to the frame.

In a preferred embodiment of the present invention, the pair of hydraulic cylinders are pivotally attached to an intermediate member and the blade. The single angle hydraulic cylinder that drives the blade to angle relative to the frame is pivotally attached to the frame and pivotally attached to the intermediate member. The intermediate member is guided upon a guide bar that extends through an arc defined about a vertical axis on the frame. The guide bar ensures that the blade is guided through a desired arc when angling relative to the frame.

The intermediate member preferably includes a pin flange extending forwardly to receive pins from each of the pair of hydraulic cylinders and a second pin flange extending rearwardly to receive a pin from the single angle hydraulic cylinder. An angle link guide on the intermediate member is received vertically between the guide bar and the frame for guiding the intermediate member through the arc.

The blade is connected to the frame through a ball joint that allows some freedom of movement relative to the frame so that the blade may pitch and tilt. The ball joint includes a pin that extends vertically upwardly and is connected to the intermediate member.

In a most preferred embodiment of the present invention, the pair of hydraulic cylinders are pinned to the intermediate member at a position longitudinally forward of the position at which the single angle hydraulic cylinder is pinned to the intermediate member.

The resulting combination provides a simplified connection of a blade to a frame while allowing full freedom of tilting, pitching and angling. Additionally, the preferred embodiment ensures that the blade is firmly guided while being moved relative to the frame. By utilizing an intermediate member connecting the cylinders, simple pivot pin connections can be utilized at all of the hydraulic cylinder connections. Also, by utilizing a single pair of hydraulic cylinders to control both the tilt and pitching of the blade, a pair of long-rod, short-stroke cylinders can be utilized which ensure close control and adequate power to drive the blade.

These and other objects and features of the present invention can be best understood by reference to the following specification and drawings, of which the following is a brief description.

DETAILED DESCRIPTION OF A PREFERRED EMBODIMENT

Figure 1:
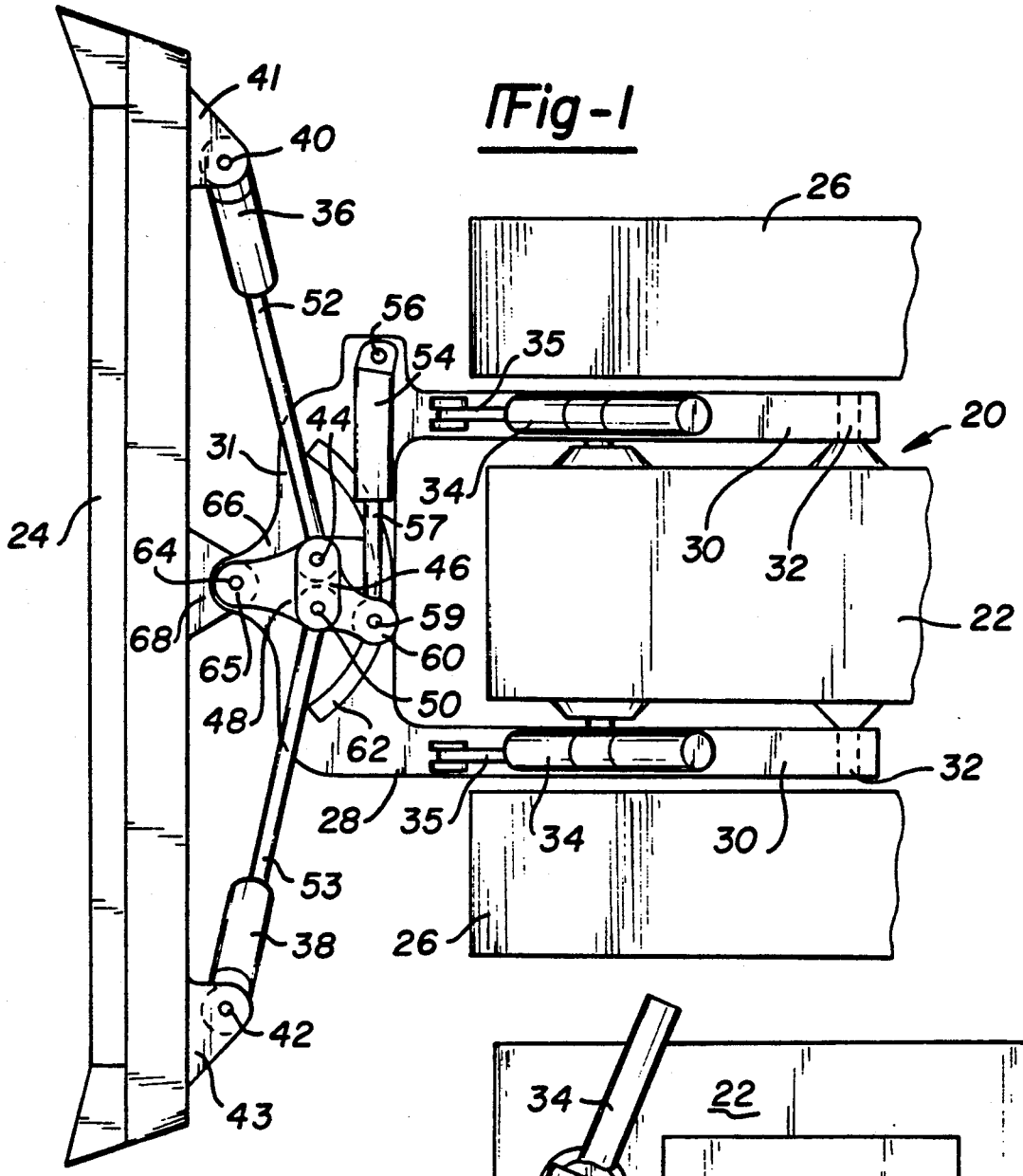
FIG. 1 is a top plan view illustrating pitch-tilt cylinders and an angle cylinder mounted through an intermediate member on a vehicle embodying the invention.

An embodiment of the present invention is illustrated in FIGS. 1, 2, 3, 4A and 4B in which tractor 20 has main frame 22 connected to conventional scraper blade 24. Track frames 26 are disposed on each lateral side of main frame 22. Conventional C-frame 28 has parallel push arms 30 extending longitudinally rearwardly which are mounted between track frames 26 and main frame 22. Parallel push arms 30 are connected by cross-beam 31 and are pinned at 32 to each lateral side of main frame 22. Lift cylinders 34 have pistons 35 that are pivotally connected to C-frame 28 and are connected to main frame 22. By extending and retracting pistons 35 within cylinder 34, blade 24 can be moved between a vertically lower, ground-engaging position and a vertically upwardly removed transport position.

First tilt-pitch cylinder 36 and second tilt-pitch cylinder 38 connect blade 24 to C-frame 28. First tilt-pitch cylinder 36 is pinned at 40 to pin flange 41 formed on a longitudinally rear face of blade 24, while second tilt-pitch cylinder 38 is pinned at 42 to pin flange 43, also formed on a rear face of blade 24. First tilt-pitch cylinder 36 is pinned at 44 to pin flange 46 formed in angle link 48. Second tilt-pitch cylinder 38 is also pinned at 50 to pin flange 46. Angle link 48 can be described as an intermediate member connecting the pair of tilt-pitch cylinders 36 and 38 to C-frame 28. Piston 52 is received in first tilt-pitch cylinder 36, and piston 53 is similarly received in second tilt-pitch cylinder 38. By extending both pistons 52 and 53 outwardly of cylinders 36 and 38 simultaneously, blade 24 can pitch forwardly about an axis extending transverse to the longitudinal axis defined by frame 22. By retracting both pistons 52 and 53 within cylinders 36 and 38 simultaneously, blade 24 will pitch rearwardly about the same axis. By extending one of pistons 52 and 53 and retracting the other, the blade can be caused to tilt or pivot about the longitudinal axis defined by main frame 22.

Angle cylinder 54 is pinned at 56 to C-frame 28 and includes piston 57 which is pinned to pin flange 60 on angle link 48. Pin 59 is positioned longitudinally rearwardly of the position of pins 44 and 50 which connect tilt-pitch cylinders 36 and 38 to angle link 48.

Guide bar 62 is defined on C-frame 28 and extends through an arc defined about an axis extending vertically. Angle link 48 is guided on guide bar 62 in a manner to be explained below.

Center pivot pin 64 is connected to angle link center pivot flange 65, C-frame center pivot flange 66 and blade ball joint flange 68. Thus, center pivot pin 64 connects blade 24, C-frame 28 and angle link 48.

Angle link 48 can pivot with respect to blade 24 and is guided on guide bar 62. The three hydraulic cylinders 36, 38 and 54 each pivot on a single axis relative to angle link 48. No relatively complex universal connections are required between the cylinders 36, 38 and 54 and angle link 48, yet full freedom of movement is provided to blade 24. The movement of angle link 48 compensates for the differing axes of movement of the three cylinders 36, 38 and 54 and provides a relatively sturdy connection.

The combination of hydraulic cylinders 36 and 38 being positioned longitudinally forwardly of angle cylinder 54 results in an arrangement by which blade 24 will be more accurately guided when moving relative to C-frame 28. Since the angling operation generally involves greater angular movement than either tilting or pitching, it is beneficial to have the angle cylinder located longitudinally rearmost. Piston 57 is extended or retracted relative to cylinder 54 to drive blade 24 to angle through angle link 48 and its connection with cylinders 36 and 38. Short-stroke cylinders may be used for hydraulic cylinders 36 and 38 which provide a more stable connection between blade 24 and C-frame 28. Short-stroke hydraulic cylinders may be more accurately controlled than the longer stroke cylinders utilized in the prior art.

Figure 2:
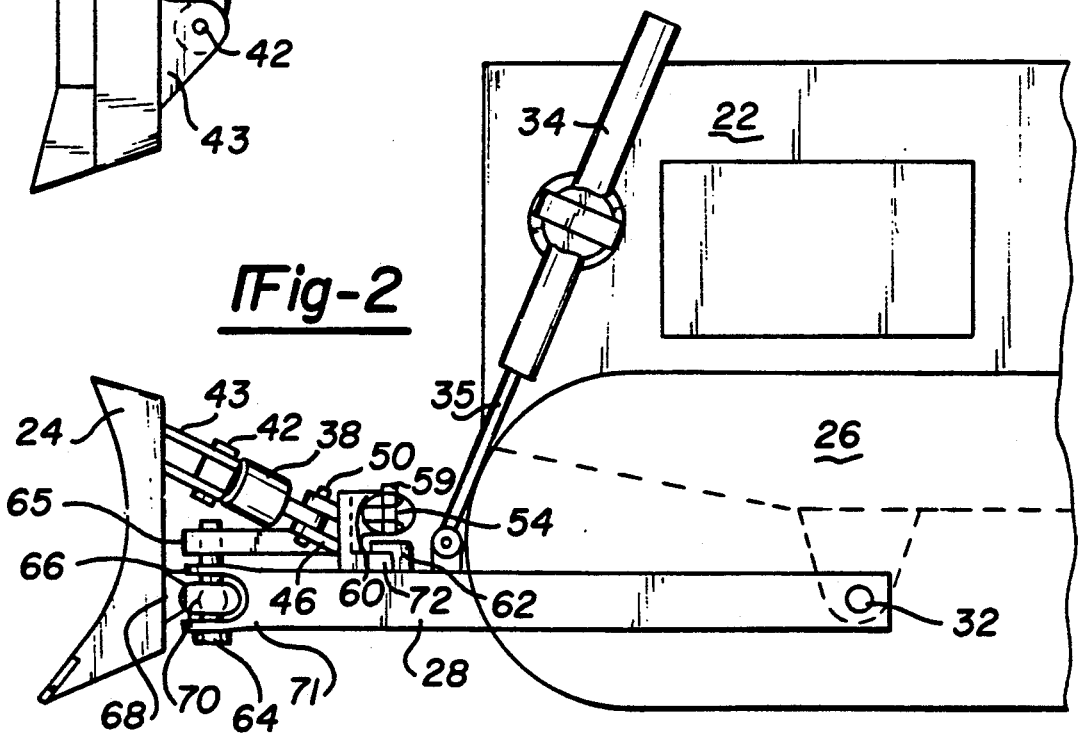
FIG. 2 is a side elevational view of the front of a vehicle embodying the present invention.

As shown in FIG. 2, center pivot pin 64 is connected through ball joint 70 to ball joint flange 68. This connection provides some freedom of movement to allow blade 24 to pitch and tilt through a small angular extent. C-frame center pivot flange 66 and C-frame lower pivot flange 71 are positioned on each side of ball joint 70. Angle link center pivot flange 65 is mounted on pin 64 at a position vertically above C-frame center pivot flange 66.

Angle link 48 includes pin flange 46 extending forwardly and vertically upwardly which is pinned at 50 to cylinder 38. Since cylinders 36 and 38 extend vertically upwardly between angle link 48 and blade 24, the cylinders 36 and 38 cause blade 24 to tilt when one is retracted and the other extended.

Piston 57, associated with angle cylinder 54, is pinned at 59 to pin flange 60 which extends rearwardly from angle link 48. Angle link guide 72 is vertically intermediate guide bar 62 and C-frame 28. The use of angle link 48 as an intermediate member to interconnect blade 24, C-frame 28, tilt-pitch cylinders 36 and 38 and angle cylinder 54 provides an arrangement through which the majority of the movements of the various members are relative to a single pivot axis rather than a relatively complex universal joint. Only ball joint 70 need allow any substantial freedom of movement about an axis other than a single pivot axis. The entire mounting arrangement is thus much more stable than the prior art and is relatively simplified.

Figure 3:
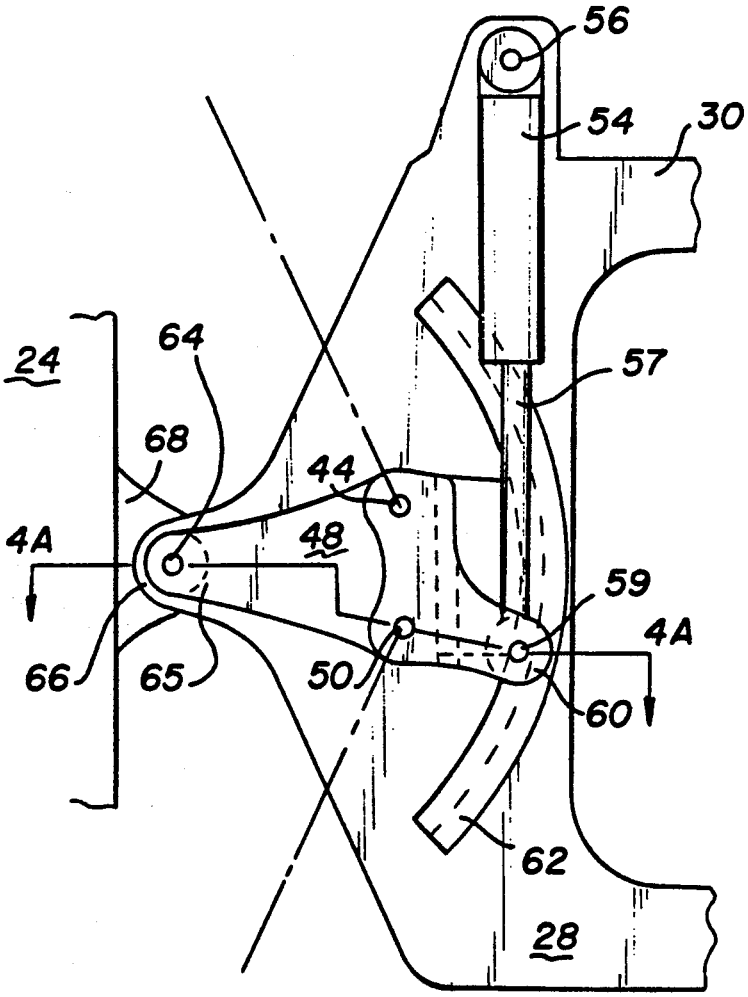
FIG. 3 is a partial view showing details of the connection of the blade to the frame of the vehicle.

As shown in FIG. 3, angle cylinder 54 is connected through piston 57 to pin 59 in pin flange 60. Angle link 48 is guided on guide bar 62. Pin 64 connects angle link center pivot flange 65 and C-frame center pivot flange 66 with blade ball joint flange 68.

Figure 4A:
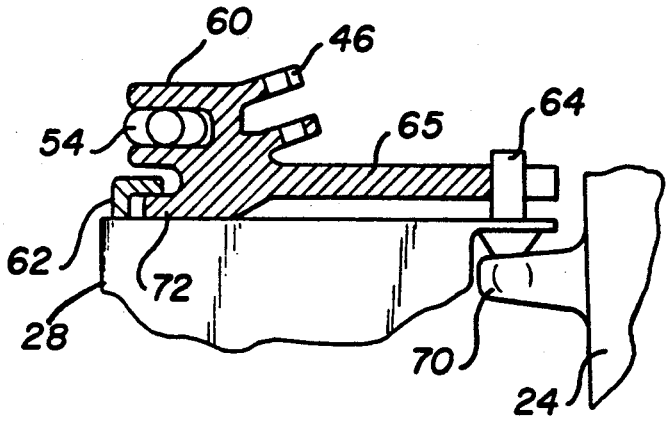
FIG. 4A is a cross-sectional view along lines 4A—4A as illustrated in FIG. 3.

FIG. 4A shows details of angle link 48 including pin flange 60 receiving pin 59, guide bar 62 providing a slot for receiving angle link guide 72 at a location between guide bar 62 and C-frame 28, and pin flange 46 extending forwardly and vertically upwardly from the remainder of angle link 48.

Figure 4B:
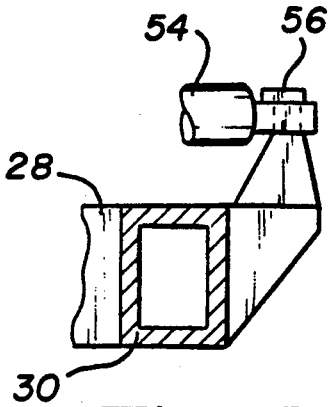
FIG. 4B is a cross-sectional view showing further details of the connection illustrated in FIG. 3.

FIG. 4B shows details of the connection of angle cylinder 54 through pin 56 to C-frame 28. Angle cylinder 54 is free to pivot about a vertical axis defined by pin 56.

Figure 5:
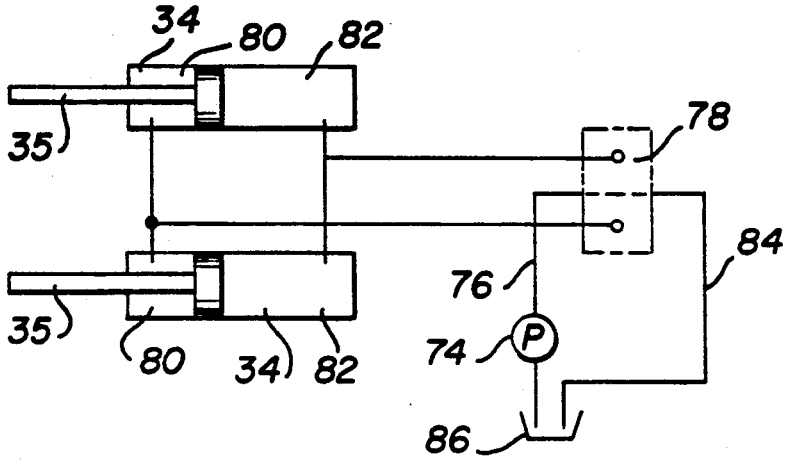
FIG. 5 is a schematic view of a lift circuit for vertically moving the blade.

Hydraulic circuitry for controlling the hydraulic cylinders 34, 36, 38 and 54 will now be disclosed with reference to FIGS. 5–10. A lift circuit is illustrated in FIG. 5 and includes hydraulic pump 74 sending hydraulic fluid through line 76 to two-way valve 78. Two-way valve 78 connects line 76 to one of a raise chamber 80 or a lower chamber 82. The other chamber is connected to line 84 which leads to hydraulic reservoir 86.

Figure 6:
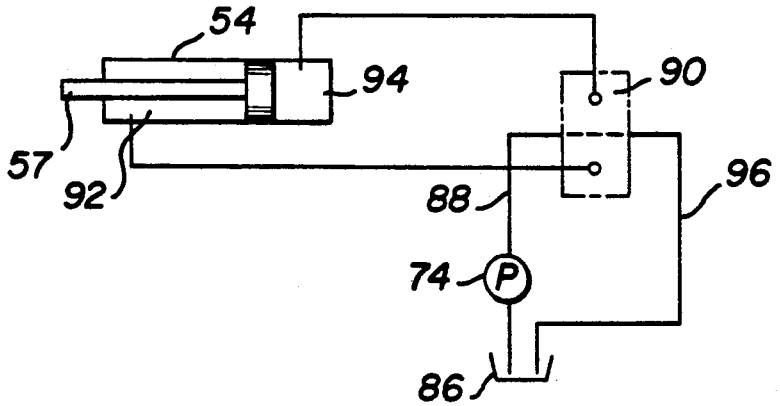
FIG. 6 is a schematic view of an angling circuit for angling the blade relative to the frame.

FIG. 6 shows the angle circuit for powering angle cylinder 54. Hydraulic pump 74 sends hydraulic fluid through line 88 to two-way valve 90. Two-way valve 90 connects line 88 to retraction chamber 92 or extension chamber 94 formed on each side of piston 57. Piston 57 is either driven into or out of hydraulic cylinder 54 to drive blade 24 to angle relative to C-frame 28. Two-way valve 90 connects the other of chambers 90 and 92 to line 96 leading to hydraulic reservoir 86.

Figure 7:
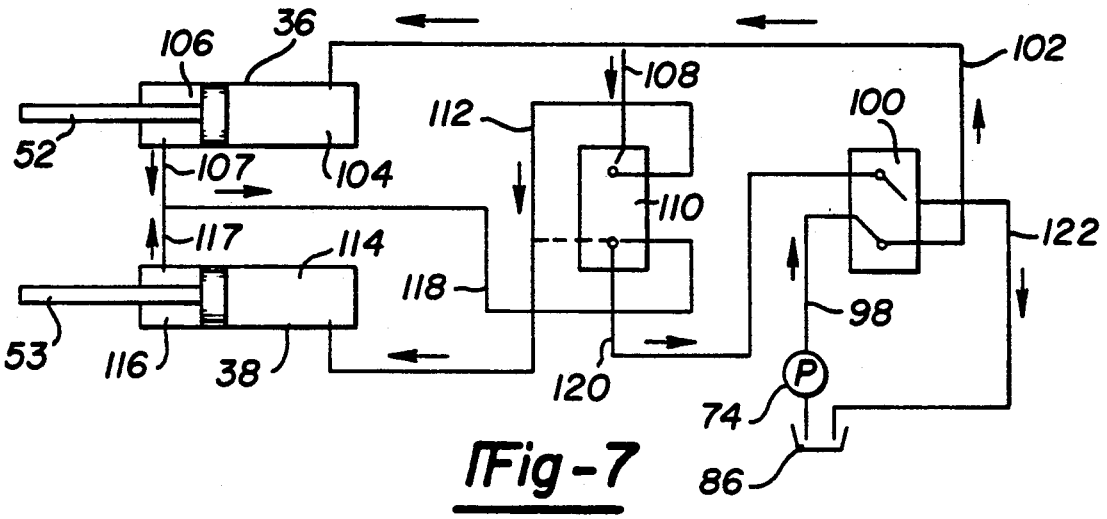
FIG. 7 is a schematic view of a hydraulic circuit for pitching or tilting the blade showing the circuit in a pitch-forward position.

FIG. 7 shows a pitch-tilt circuit which drives cylinders 36 and 38 to pitch or tilt blade 24. Pump 74 supplies fluid through line 98 into two-way valve 100. In the position illustrated in FIG. 7, two-way valve 100 connects line 98 to line 102 which is connected to extension chamber 104 in first tilt-pitch cylinder 36. As piston 52 is driven outwardly of cylinder 36, fluid is driven from retraction chamber 106 into line 107. Tap line 108 is connected to line 102 and extends into two-way valve 110. In the position illustrated in FIG. 7, valve 110 connects tap line 108 to line 112 which extends into extension cylinder 114 of second tilt-pitch cylinder 38. Piston 53 is driven outwardly of second tilt-pitch cylinder 38, and fluid is driven from retraction chamber 116 into line 117. Fluid from both lines 107 and 117 is driven into line 118 which is connected by valve 110, in the position illustrated in FIG. 7, to line 120. Line 120 extends back to valve 100, and is connected to line 122 leading to hydraulic reservoir 86. In this position, pistons 52 and 53 are driven to extend outwardly of hydraulic cylinders 36 and 38, and blade 24 pitches forwardly with respect to C-frame 28.

Figure 8:
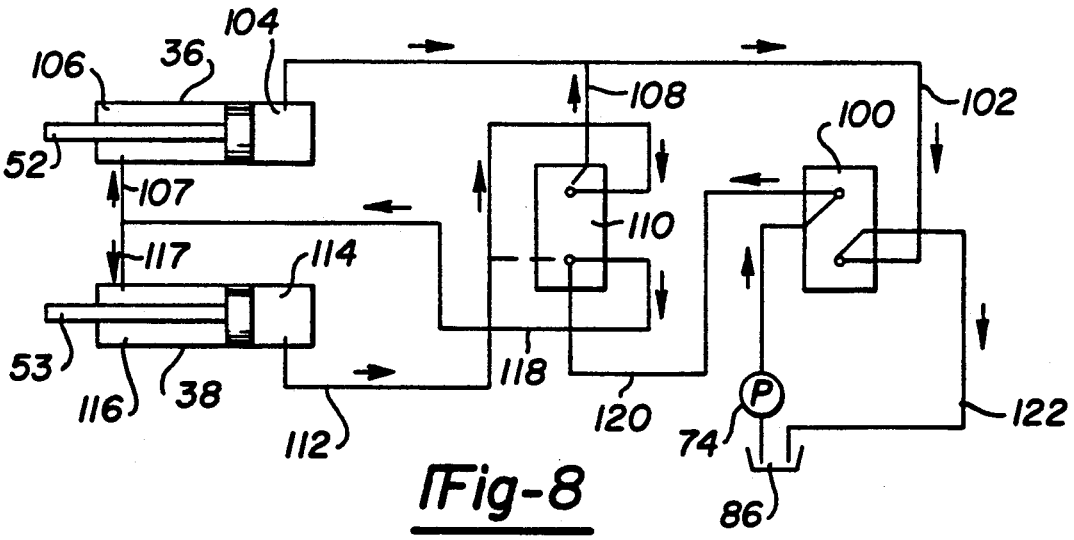
FIG. 8 is a schematic view of the circuit illustrated in FIG. 7, but showing the circuit in a pitch-back position.

The pitch-tilt circuit illustrated in FIG. 7 is shown in a pitch-rearward position in FIG. 8. Valve 100 has moved to a second position, and line 98 is now connected to line 120. Valve 110 remains in the position illustrated in FIG. 7, with line 120 connected to line 118 and therethrough to lines 107 and 117. Thus, fluid from hydraulic pump 74 is sent to retraction cylinders 106 and 116, and pistons 52 and 53 retract into tilt-pitch hydraulic cylinders 36 and 38. Fluid from chamber 104 is driven into line 102, and fluid from chamber 114 is driven into line 112. The fluid in line 112 is connected through valve 110 to tap line 108 and back into line 102. Two-way valve 100 now connects line 102 to line 122 and back to hydraulic reservoir 86. In the illustrated position, pistons 52 and 53 are both retracted into hydraulic cylinders 36 and 38, and blade 24 is driven to pitch rearwardly relative to C-frame 28.

Valve 110 could be said to be in a pitch position as illustrated in FIGS. 7 and 8. The position of valve 100 controls the direction of pitch.

Figure 9:
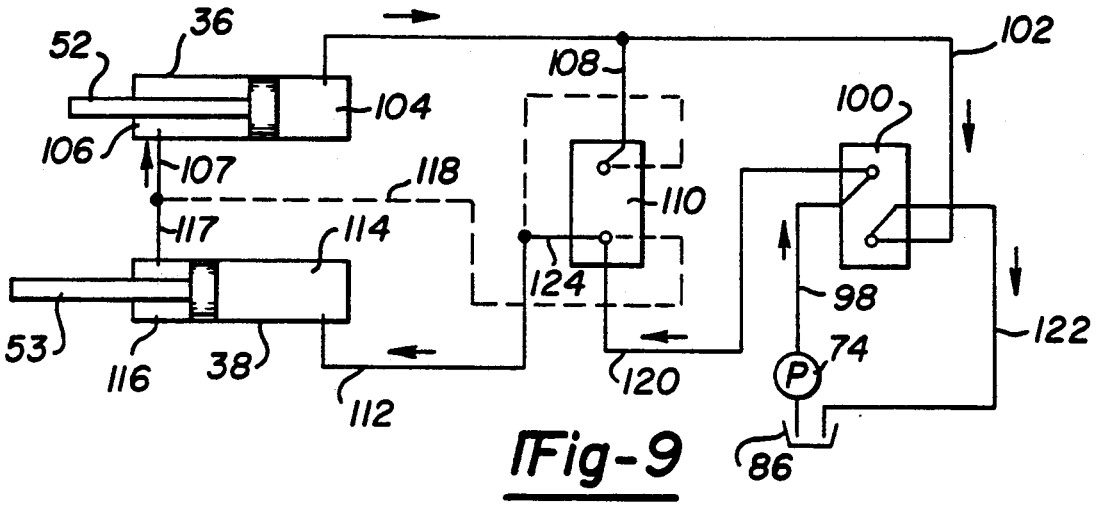
FIG. 9 is a schematic view of the circuit illustrated in FIG. 7, but showing the circuit in tilt-right position.

The tilt-pitch circuit is illustrated in FIG. 9 in a tilt-right position. Valve 100 connects line 98 to line 120 and line 102 to line 122. However, in this position, valve 110 is moved to a second position, and tap line 108 is short-circuited. Also, a shunt line 124 connects line 120 to line 112. Thus, hydraulic fluid from pump 74 is passed from line 98, to line 120, to shunt line 124 and into line 112. From line 112, the hydraulic fluid enters extension chamber 114 of second tilt-pitch cylinder 38. Piston 53 is driven outwardly of second tilt-pitch cylinder 38, and fluid is driven from retraction cylinder 116 into line 117. Line 118 is also short-circuited by valve 110 and fluid is driven from line 117 to line 107 and into retraction cylinder 106 of first tilt-pitch cylinder 36. This drives piston 52 to retract within first tilt-pitch hydraulic cylinder 36 and drives fluid from extension chamber 104 into line 102. In the position illustrated in FIG. 9, fluid from hydraulic pump 74 is directed into chamber 114 of second tilt-pitch cylinder 38 and from extension cylinder 104 of first tilt-pitch cylinder 36 to hydraulic reservoir 86. Blade 24 tilts to the right about a longitudinal axis defined by C-frame 38.

Figure 10:
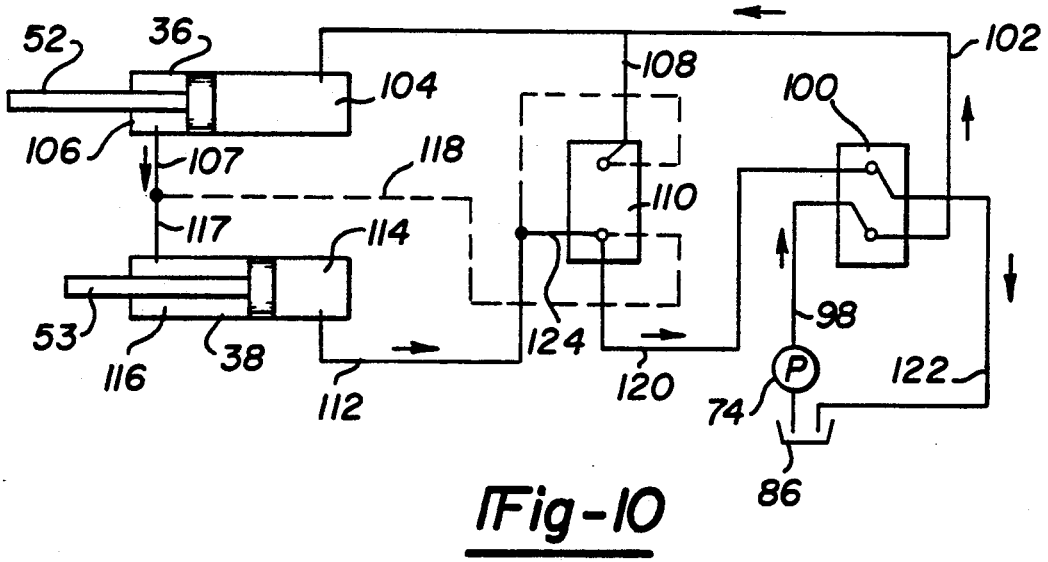
FIG. 10 is a schematic view of the circuit illustrated in FIG. 7, but showing the circuit in a tilt-left position.

The circuit illustrated in FIG. 9 is shown in FIG. 10 in a tilt-left position. Valve 100 has now moved to a second position, and line 98 is connected through line 102 to extension chamber 104 of first tilt-pitch cylinder 36. Two-way valve 110 has remained in the position illustrated in FIG. 9. Tap line 108 is still short-circuited, and line 120 is still connected by shunt line 124 to line 112. Line 118 is also still short-circuited. Fluid is driven from chamber 106 into line 107, into line 117 and into retraction chamber 116 of second tilt-pitch cylinder 38. Fluid is driven out of extension chamber 114 into line 112, through shunt line 124, and into line 120. Two-way valve 100 connects line 120 to line 122 and hydraulic reservoir 86. Blade 24 tilts to the left relative to the longitudinal axis defined by C-frame 38.

Valve 110 could be said to be in a tilt position as illustrated in FIGS. 9 and 10. The position of valve 100 controls the direction of tilt.

Well-known controls may be utilized to affect the positions of valves 100 and 110.

An embodiment of the present invention has been disclosed; however, a worker of ordinary skill in the art would realize that certain modifications would fall within the scope of this invention, and thus the following claims should be reviewed in order to determine the true scope and content of the present invention.

I claim:

1. In an earth-working vehicle, a blade mounting arrangement comprising:

an earth-engaging blade;

a frame defining a longitudinal axis;

means to connect said blade to said frame, said means to connect allowing said blade to be moved to pitch forwardly or rearwardly by pivoting about an axis transverse to said longitudinal axis, to tilt by pivoting about said longitudinal axis, or to angle by pivoting about an axis extending vertically relative to said longitudinal axis; and hydraulic cylinders for controlling the pitch, tilt and angling movement;

said hydraulic cylinders being pivotally connected to an intermediate member, said intermediate member being pivotally connected to said blade and movable relative to said frame;

wherein a pair of hydraulic cylinders control the pitch and tilt, and a single hydraulic cylinder controls angle movement; and wherein said pair of hydraulic cylinders is pivotally connected to said blade and pivotally connected to said intermediate member, said single hydraulic cylinder is pivotally connected to said frame and pivotally connected to said intermediate member.

2. The vehicle recited in claim 1, wherein said pair of hydraulic cylinders is pivotally connected to said intermediate member at a position longitudinally forwardly of the position said single hydraulic cylinder is pivotally connected to said intermediate member.

3. The vehicle recited in claim 2, wherein said intermediate member comprising a forwardly-extending flange receiving pins for pivotally connecting said pair of hydraulic cylinders, said intermediate member further comprising a rearwardly extending flange connected to said single hydraulic cylinder, a guide bar formed on said frame for guiding said intermediate member through an arc, said guide bar defining a notch to receive an angle link guide of said intermediate member between said guide bar and said frame.

4. The vehicle recited in claim 1, wherein said intermediate member comprising a forwardly-extending flange receiving pins for pivotally connecting said pair of hydraulic cylinders, said intermediate member further comprising a rearwardly extending flange connected to said single hydraulic cylinder, a guide bar formed on said frame for guiding said intermediate member through an arc, said guide bar defining a notch to receive an angle link guide of said intermediate member between said guide bar and said frame.

5. The vehicle recited in claim 4, wherein said forwardly-extending flange also extends vertically upwardly.

6. The vehicle recited in claim 1, wherein a single hydraulic circuit controls said pair of hydraulic cylinders to pitch and tilt said blade.

7. The vehicle recited in claim 6, wherein said single hydraulic circuit comprising a pair of two-way valves, one valve having a tilt position and a pitch position, the other valve controlling the direction of pitch or tilt.

8. In an earth-working vehicle, a blade mounting arrangement comprising:

an earth-engaging blade;

a frame defining a longitudinal axis:

means to connect said blade to said frame, said means to connect allowing said blade to be moved to pitch forwardly or rearwardly by pivoting about an axis transverse to said longitudinal axis, to tilt by pivoting about said longitudinal axis, or to angle by pivoting about an axis extending vertically relative to said longitudinal axis; and hydraulic cylinders for controlling the pitch, tilt and angling movement;

said hydraulic cylinders being pivotally connected to an intermediate member, said intermediate member being pivotally connected to said blade and movable relative to said frame; and said intermediate member is guided through an arc about a vertical axis on said frame.

9. In an earth-working vehicle, a frame comprising a generally C-shaped structure having opposed arms and defining a longitudinal axis, the free ends of said arms being connected to said vehicle, the other ends of said arms being connected by a crossbeam member, a ground-engaging blade, means for universally mounting said blade on the forward end of said crossbeam, the improvement comprising:

means to connect said blade to said C-shaped structure, said means to connect allowing said blade to pitch forwardly or rearwardly by pivoting about an axis transverse to said longitudinal axis, to tilt by pivoting about said longitudinal axis or to angle by pivoting about an axis extending vertically to said longitudinal axis;

a pair of hydraulic cylinders alternately controlling the pitching or tilting of the blade relative to the C-shaped structure, a single hydraulic cylinder controlling the angling movement; and wherein said pair of hydraulic cylinders being pivotally connected to said blade and pivotally connected to an intermediate member, said single hydraulic cylinder being pivotally connected to said C-shaped structure and pivotally connected to said intermediate member.

10. The vehicle recited in claim 9, wherein said intermediate member being pivotally connected to said blade and being guided through an arc about a vertical axis on said C-shaped structure.

11. The vehicle recited in claim 10, wherein said blade being connected to said C-shaped structure at a ball joint, said ball joint having a pin pivotally connected to said intermediate member.

12. The vehicle recited in claim 9, wherein said blade being connected to said C-shaped structure at a ball joint, said ball joint having a pin pivotally connected to said intermediate member.

* * * * *